United States Patent [19]

Scott

[11] Patent Number: 4,574,578

[45] Date of Patent: Mar. 11, 1986

[54] SYNTHETIC YARN AND YARN-LIKE STRUCTURES AND A METHOD FOR THEIR PRODUCTION

[75] Inventor: Alexander Scott, Paisley, Scotland

[73] Assignee: J&P Coats Limited, Glasgow, Scotland

[21] Appl. No.: 600,040

[22] Filed: Apr. 13, 1984

[30] Foreign Application Priority Data

Apr. 14, 1983 [GB] United Kingdom ..... 8310072

[51] Int. Cl.[4] ..... D02G 3/30; D02G 3/34

[52] U.S. Cl. ..... 57/246; 57/208; 57/247; 57/283; 57/290

[58] Field of Search ..... 57/204, 205, 206, 208, 57/246, 247, 282, 283, 284, 293, 290

[56] References Cited

U.S. PATENT DOCUMENTS

| | | | |
|---|---|---|---|
| 3,298,169 | 1/1967 | Comer | 57/290 |
| 3,433,008 | 3/1969 | Gage | 57/246 X |
| 3,483,691 | 12/1969 | Williams et al. | 57/246 X |
| 4,167,847 | 9/1979 | Arai et al. | 57/246 X |
| 4,402,178 | 9/1983 | Negishi et al. | 57/283 X |
| 4,501,046 | 2/1985 | Krenzer | 57/246 X |

*Primary Examiner*—Donald Watkins
*Attorney, Agent, or Firm*—Larson and Taylor

[57] ABSTRACT

Synthetic yarn and yarn-like structures are formed by the method of treating separate multifilament strands of thermoplastics material so that at least one has a shrinkage ratio higher than normal at an elevated temperature. The strands are intermingled in a gas stream with formation of loops on the strands after which they are subjected to a twisting force which imparts a random form of twist on the intermingled formation followed by a heating operation to cause them to shrink differentially while being held until shrinkage ceases so that interlocking bud-like projections form on the filaments. Apparatus for performing the method includes yarn drawing means, intermingling means comprising a jet device incorporating intersecting passages for the strands and for a gas under pressure, means arranged to apply a twisting force to the intermingled filaments, feeding means and heating and cooling means for the intermingled yarn incorporating twist downstream from the jet device, also means for holding the yarn to a predetermined length while it is being heated and cooled.

6 Claims, 5 Drawing Figures

SYNTHETIC YARN AND YARN-LIKE STRUCTURES AND A METHOD FOR THEIR PRODUCTION

Figure 1:
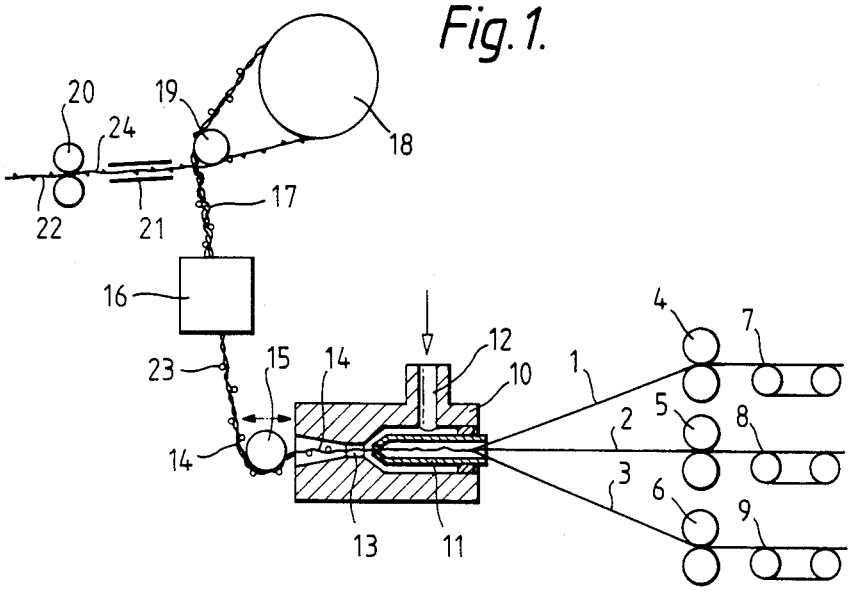

The subject of this invention is a multifilament synthetic yarn and a method and apparatus for manufacturing the yarn. In the following description the word "yarn" is used in its broadest textile sense and also as including all yarn-like structures. It is to be understood as including doubled yarns such as sewing thread as well as yarns of all types for making up into woven and knitted structures. It is also to be understood as including structures of yarn-like form including strings, twines and ropes.

In the specification of the earlier U.S. patent application No. 339,888 there is described a method of producing a substantially twistless yarn from at least two separate strands of thermoplastics strand material comprising treating at least one strand to cause it to have a shrinkage ratio higher than normal at an elevated temperature for the particular material of the strand, subjecting the strands to a turbulent stream of fluid while feeding them forwardly at different rates of feed so that loops form on the strands and the strands become intermingled whereby they form an intermingled yarn, heating successive quanta of the intermingled yarn to a temperature sufficient to cause the strands to shrink differentially while holding each quantum of intermingled yarn to a predetermined length and cooling each said quantum to a temperature below that at which shrinkage ceases while the predetermined length is maintained.

The previous method described above provides for most purposes an excellent substantially twistless thread. It has been found, however, that for certain purposes, particularly those where a very flexible thread is required the yarn produced by the method described has less flexibility than is desirable.

The present invention relates to a modified process incorporating most of the features of the process described above and providing a yarn which not only exhibits improved flexibility but which has, surprisingly, other improved attributes.

According to the invention a method of producing a yarn from at least two separate multifilament strands of thermoplastics strand material by treating at least one strand to cause it to have a shrinkage ratio higher than normal at an elevated temperature for the particular material of the strand, subjecting the strands to a turbulent stream of fluid while feeding them forwardly at different rates of feed so that loops form on the filaments of the strands and the strands become intermingled whereby they form a yarn, heating successive quanta of the yarn so formed to a temperature sufficient to cause the filaments formerly making up different strands to shrink differentially while holding each said quantum of yarn to a predetermined length and cooling each said quantum to a temperature below that at which shrinkage ceases while the predetermined length is maintained is characterized by applying to the intermingled filaments before the heating step a twisting force effective to superimpose on the intermingled filaments a twist which has an angular orientation which is varying and is on average smaller than normal for the particular gauge of the yarn.

As an example an effective smaller than normal twist applied to yarn of the invention intended to be used in or as a sewing thread lies within the range 100–300 turns per meter when the normal twist for a corresponding traditional doubled sewing yarn customarily lies within the range 600–1300 turns per meter.

The twist imparted to the yarn may be a real or a false twist.

The twist may conveniently be applied at a point immediately after the intermingling operation. This normally requires interruption in the continuity of the process. The process may be performed non-stop by false twisting the yarn. The false twisting operation may be performed by causing the filaments of the moving yarn to adhere together periodically over a minute length of yarn at a position upstream from the position where the false twisting operation is performed.

The periodic fixing together of the filaments limits and locates the position on the yarn at which the superimposition of the intermingling and each false twisting operation takes place.

Apparatus for performing the process may comprise drawing means for initially drawing the separate multifilament strands to a chosen ratio of draw, intermingling means for bringing the yarn strands together and intermingling them, feeding means arranged to feed the strands to the intermingling means at different rates of overfeed with respect to the rate at which yarn formed in the intermingling means leaves the intermingling means, heating means for applying heat to the formed yarn, means for holding successive quanta of intermingled yarn to a predetermined length while the heat is being applied by the heating means and while cooling of the yarn is taking place and means for removing the yarn continuously from the heating means, characterized in that the apparatus includes twisting means arranged to apply a twisting force to the yarn after it leaves the intermingling means and before it reaches the heating means.

The invention also resides in the provision of a yarn formed by the process of the invention, said yarn comprising at least two multifilament strands intermingled with one another, the filaments of at least one strand presenting a series of bud-like projections constituted by tightened loops which inhibit relative movement of the filaments and the intermingled strands having superimposed on the intermingled structure a twist which has an angular orientation which is varying and is on average smaller than normal for the particular gauge of the yarn.

The actual amount of twist may vary from strand to strand and even from filament to filament.

Several yarns of the invention may be laid together e.g. by twisting to form a plied yarn and several plied yarns according to the invention may be laid together to form a cabled yarn.

A plying operation and/or a cabling operation employing yarns according to the invention may be performed by a known method.

Figure 4:
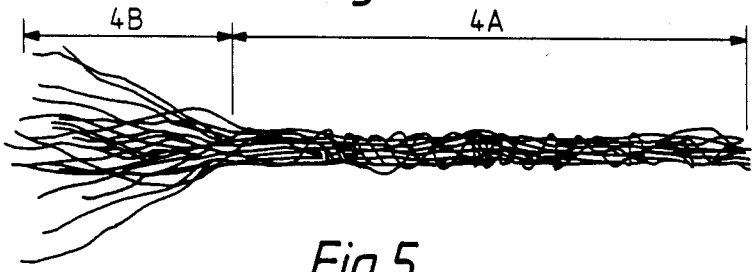
Figure 5:
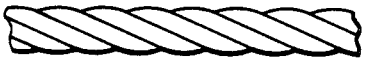

A practical embodiment of apparatus according to the invention is illustrated in the accompanying semi-diagrammatic drawing designated as FIG. 1. The apparatus is shown as making a yarn from three multifilament strands. Other numbers of strands may be employed, the only difference in the apparatus being a corresponding change in the number of feed and draw rollers. A length of yarn shown for simplicity as incorporating only three strands, each comprising only one filament, each formed with loops and the strands intermingled in the form in which the yarn leaves the jet device is illustrated to a greatly enlarged scale in FIG. 2. A substantially twistless multifilament yarn formed by the method previously referred to is illustrated in FIG. 3, one end being teased out to show more clearly the lack of twist and FIG. 4 shows a yarn of the present invention with one end teased out to show more clearly the difference from the substantially twistless yarn of FIG. 3. For comparison a normally twisted yarn is shown in FIG. 5. In practice the yarns of the invention will have many more filaments than are shown in the drawings.

Figure 2:
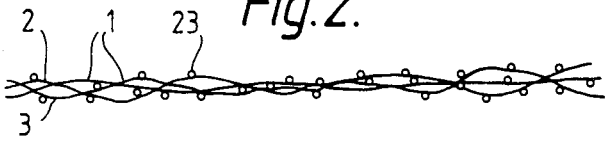
Figure 3:
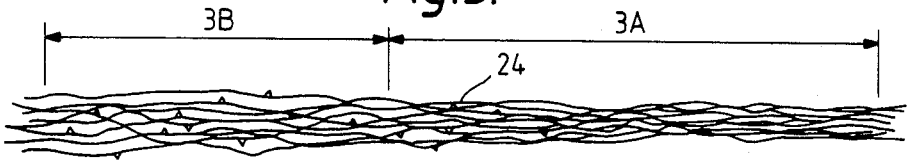

In the drawings and referring first to FIG. 1, 1, 2 and 3 denote different strands, each comprising a bundle of filaments. 4, 5 and 6 denote respective sets of feed rollers for the strands arranged to feed the strands forwardly at different rates of feed, the feed rollers for one strand, for example 1, being preferably arranged to feed at a rate which is lower than that of the other strands and may be only slightly above the take-off speed from the intermingling means referred to later as the jet device 10 and the feed rollers for the other strands 2 and 3 being arranged to feed the strands 2 and 3 at rates considerably above said take-off speed although different from one another. 7, 8 and 9 denote draw rollers. A suitable drawing action on the strands 2 and 3 is that sufficient to provide a drawing ratio around 50% higher than normal. The ratio of drawing gives high shrinkage characteristics to the strand material. 10 denotes intermingling means constituted by a jet device having a passage 11 arranged to receive the strands 1, 2 and 3 coming from the feed rollers and 12 denotes an inlet passage for a fluid at a temperature below the plasticization temperature of the strand material. 13 denotes a mixing zone where the fluid meets the strands and causes the strands and their filaments to intermingle with one another to produce a substantially twistless yarn 14 in which the strands no longer have a separate identity. 15 denotes a barrier which is movable towards and from the body of the jet device. The barrier has a beneficial effect on operation of the jet device and is well known in the art. 16 denotes apparatus for applying a twisting action to the previously substantially twistless yarn to produce a yarn containing intermingled filaments which are twisted with an angular orientation which is varying and is on average smaller than normal for that gauge of yarn. 18 denotes a heating roller and 19 denotes a separator roller. 20 denotes nip rollers the function of which is to hold the quantum of yarn located between the separator roller 19 and the nip rollers 20 against further shrinkage while the shrunk yarn is being cooled in a cooling zone 21 to a temperature at which further shrinkage cannot take place. 22 denotes finished yarn on its way to the winding apparatus.

In FIG. 2 the strands each shown for simplicity as comprising one filament are illustrated as they leave the jet in an intermingled state. The filaments forming the strands are doubled back on one another at intervals to form loops 23. It is not practicable here to show the strands correctly as multifilaments, but the loops are actually formed on the individual filaments and are much greater in number than as illustrated. The portion 3A of FIG. 3 illustrates a portion of yarn after the intermingling action during which the strands have lost their identity so that the yarn is now constituted by a single bundle of filaments which differ from one another in their shrinkage characteristics but before the yarn has been subjected to the twisting action. The portion 3B illustrates an end of the yarn teased out by inserting a needle into the intermingled filaments and separating them to show the undulating movement of the individual filaments with an almost complete lack of twist. The portion 4A of FIG. 4 illustrates the yarn after being subjected first to the twisting action in the apparatus 16 and then to the differential shrinking of the separate filaments. The portion 4B illustrates one end of the yarn teased out to give an idea of the complex entanglement which has resulted. It is in fact far more difficult to tease out the yarn of the invention than to tease out a conventional twisted yarn. it is to be noted that the twisting action comprises the superimposition of twist on already intermingled filaments so that the yarn assumes a complex configuration quite different from that of a conventional twisted yarn as exemplified by FIG. 5. During the shrinkage action the loops 23 (FIG. 2) are pulled tight to form bud-like projections 24 which interact with one another and lock together. It was found impracticable to illustrate the bud-like projections and their interaction in the illustration of FIG. 4. FIGS. 3 and 4 were made from actual observations using a low power microscope.

In operation of the embodiment described the strands 1, 2 and 3 leave the drawing rollers 7, 8 and 9 with the strands 2 and 3 in a state of high shrinkage characteristics, then enter the passage 11 together although still separate from one another and with different rates of overfeed and by the driving action of the jet device 10 are moved through the mixing zone 13 in which the fluid entering by the passage 12 causes the strands to intermingle with one another and lose their identity, and with the filaments becoming formed at close intervals with loops 23 by the action of the jet device 10. The yarn 14 thus formed leaves the jet device 10 at a speed lower than the speed of entry of all the entering strands and passes by way of the barrier to the apparatus 16 which applies a twisting action to the already intermingled filaments. The yarn 17 then passes to the heating roller 18 and the separator roller 19. In its passage around these rollers each quantum of yarn in convoluted form on the rollers 18 and 19 is held at a predetermined length while being heated by the roller 18. The filaments attempt to shrink, each according to its own shrinkage characteristics, but being held to the predetermined length on the rollers 18 and 19 they collapse on one another by reason of the tensile stresses generated in them which cause the filaments to tend to contract. This action causes the loops 23 to tighten and form on the filaments the bud-like projections to which reference has already been made. The shrunk yarn when it finally leaves the heating roller 18 passes through the cooling zone 21 to the nip rollers 20. The nip rollers 20 hold the quantum of shrunk yarn between the roller 19 and the rollers 20 against further shrinkage while it is cooled in the cooling zone 21 to a temperature at which further shrinkage ceases. The yarn 22 leaving the nip rollers 20 is now in a fully stable condition. During shrinkage the bud-like projections on the several filaments interact with one another and lock together.

A practical example of performance of the process is given below:

Three separate polyester substantially twistless multifilament strands of 167 decitex (150 denier) were subjected to a degree of drawing such that they had residual shrinkages in the range 12% to 18% when measured at 180° C. Using the apparatus illustrated in FIG. 1 of the drawings and as described above the strands 2 and 3 were fed into the jet device 10 at speeds respectively 7.5% and 18% higher than that of the strand 1 which was fed into the jet device at a speed 4% higher than that at which the intermingled filaments left the jet device. It is convenient to feed in the filaments in the form of a few strands each comprising a group of filaments as it would obviously be impracticable to draw separately each filament which is to be included in a yarn containing in its finished state perhaps 100 filaments. All the filaments in each strand are drawn to the same extent but the strands lose their identity in the jet device and the filaments subsequently behave as individual filaments.

After leaving the jet device the integrated structure of intermingled filaments was subjected to a twisting action of 250 turns per meter. The yarn was then passed around the roller system heated to a temperature somewhat in excess of 180° C. which caused the filaments to shrink differentially and the bud-like projections formed by tightening of the loops to lock together while all the filaments remained orientated to different angles of twist. The average angle of twist is smaller than that normal for a yarn of the particular gauge of the example. This structure was then cooled and the locked yarn was now in a stable state such that it was suitable for use as a general purpose sewing thread. In this example the speed of the thread leaving the apparatus was 500 m/minute.

It is to be emphasized that the application of a twisting action to the yarn between the intermingling and loop-forming step and the shrinking step provides a structure which is more complex particularly after shrinkage has taken place than that of conventional twisted yarns. The complexity arises from the various structural factors which produce a "felted" construction. These factors are intermingling of the many filaments, twist, differential shrinkage of the filaments and locking of the loops. The result is first that the filaments are all twisted to varying degrees, some are highly twisted, some are barely twisted at all and some are even reversely twisted over short distances. This results from the intermingling before twisting. Filaments which in the intermingling operation cross the centre line of the yarn are sometimes twisted in the reverse direction. Then after the twisting operation the filaments are shrunk to varying degrees so that the finished yarn apart from the buds contained therein has a unique structure of a type not heretofore known in yarns. It has been found that the process provides a yarn not only of improved flexibility but also of an unexpected increase in softness and tenacity and in addition a more regular dye uptake providing a better appearance when the yarn is dyed. Some filaments are seen to form a substantially twistless core for a short distance with other filaments twisted randomly around them then these core filaments come to the surface and twist around the formerly twisted filaments which become core filaments. Thus in the sample illustrated in FIG. 4 the filaments which are core filaments at one end of the sample are not the same filaments as the core filaments appearing at the other end of the sample. It was found impossible to show this clearly in a drawing. The twisting of individual filaments is completely random and highly irregular and no set pattern is discernible. The yarn is also unique in that although incorporating twist it cannot be untwisted. The portion 4A of the yarn of FIG. 4 shown teased out was teased out only with great difficulty using a sharp needle. The yarn operates very well in sewing operations and to the naked eye has an appearance comparable with known types of sewing thread. The resultant yarn has attributes which represent a considerable advance on yarns of normal quality and known construction while the yarn of the invention is cheaper and quicker to produce than conventional yarns. In saying this it must be stated that it is not cheaper and quicker to produce than the substantially twistless yarn we have described earlier in this specification but it has special characteristics which make it particularly suitable for particular applications.

The present invention is applicable to such a wide variety of yarn-like structures that it is not possible in most cases to give specific parameters for the shrinkage, draw ratio temperature and angular orientation of twist. Thus in this specification the word "normal" has been used associated with these parameters to indicate the parameters lying within a range of parameters well known to those engaged in the performance of the art as the parameters customarily employed.

What I claim is:

1. A method of producing a yarn from at least two separate multifilament strands of thermoplastics strand material by treating at least one strand to cause it to have a shrinkage ratio higher than any ratio lying within the range of shrinkage ratios known throughout the art as normal for the particular material of the strand at a particular elevated temperature, subjecting the strands to a turbulent stream of fluid while feeding them forwardly at different rates of feed so that loops form on the filaments of the strands and the strands become intermingled whereby they form a yarn, heating successive quantum of the yarn so formed to a temperature sufficient to cause the filaments formerly making up different strands to shrink differentially while holding each said quantum of yarn to a predetermined length and cooling each said quantum to a temperature below that at which shrinkage ceases while the predetermined length is maintained including the step of applying to the intermingled filaments before the heating step a twisting force effective to superimpose on the intermingled filaments a twist which has an angular orientation which is varying and is on average smaller than the range of angular orientation of twist known throughout the art as normal for the particular gauge and type of the yarn.

2. The method as claimed in claim 1 in which the smaller than normal twist applied to the yarn lies within the range 100–300 turns per meter when the normal twist for that yarn is in the range 600–1300 turns per meter.

3. The method as claimed in claim 1 in which the twist imparted to the yarn is a false twist.

4. The method as claimed in claim 1 in which the twist is applied at a point immediately after the intermingling operation.

5. The method as claimed in claim 3 in which the filaments of the moving yarn are caused to adhere together periodically over a minute length of yarn at a position upstream from the position where the false twisting operation is performed.

6. Yarn comprising at least two multifilament strands intermingled with one another, the filaments of at least one strand presenting a series of bud-like projections constituted by tightened loops which inhibit relative movement of the filaments in which the intermingled strands have superimposed on the intermingled structure a twist which has an angular orientation which is varying and is on average smaller than the range of angular orientation of twist known throughout the art as normal for the particular gauge and type of the yarn.

* * * * *